United States Patent [19]

Hirahara

[11] 4,189,695

[45] Feb. 19, 1980

[54] CURRENT LIMITING FUSE DEVICE EMPLOYING COOLING AND INSULATING MEDIUM

[75] Inventor: Shigeyoshi Hirahara, Tabata-Shinmachi, Japan

[73] Assignee: Hinode Electric Machine Co., Ltd., Tokyo, Japan

[21] Appl. No.: 794,652

[22] Filed: May 6, 1977

[30] Foreign Application Priority Data

Oct. 8, 1976 [JP] Japan ..... 51-139949[U]

[51] Int. Cl.[2] ..... H01H 85/40

[52] U.S. Cl. ..... 337/204; 337/280

[58] Field of Search ..... 337/204, 166, 280, 277; 361/41

[56] References Cited

U.S. PATENT DOCUMENTS

| | | | |
|---|---|---|---|
| 3,453,579 | 7/1969 | Cinquin | 337/166 |
| 3,693,128 | 9/1972 | Jacobs, Jr. | 337/166 |
| 3,710,295 | 1/1973 | Staub et al. | 337/204 |
| 3,793,603 | 2/1974 | Fontaine | 337/166 |
| 4,041,434 | 8/1977 | Jacobs, Jr. et al. | 337/204 |
| 4,058,785 | 11/1977 | Frind et al. | 337/204 |

*Primary Examiner*—Harold Broome

*Attorney, Agent, or Firm*—Wenderoth, Lind & Ponack

[57] ABSTRACT

The present invention is a current limiting fuse device for protecting a power semiconductor element for use in a large current device such as DC-AC or AC-DC converter from overcurrent. The current limiting fuse device includes an outer casing filled with a cooling and insulating oil, a cylindrical body immersed in the cooling and insulating oil having sealed therein a hollow fuse element with an arc suppression agent, and a pair of conductive terminal holding fittings each conductively coupled to a respective end of the hollow fuse element, secured to the respective ends of the cylindrical body at one end so as to allow the cooling and insulating oil to pass through an inner bore in the hollow fuse element, and projected from said outer casing at the other end.

3 Claims, 4 Drawing Figures

CURRENT LIMITING FUSE DEVICE EMPLOYING COOLING AND INSULATING MEDIUM

BACKGROUND OF THE INVENTION

1. Field of the Invention

The present invention relates to an improvement in a fuse device, particularly to a current limiting fuse device for protecting a semiconductor element for use in a large current circuit from excess current.

2. Description of the Prior Art

With improvement of semiconductor element techniques in the recent years, a semiconductor rectifier element such as a diode or a thyristor may be used instead of a conventional mercury converter or power rectifier as an AC-DC or DC-AC converter for direct current transmission. As well known, however, a semiconductor element has a lower tolerance for excess current and a greater thermal fragility as compared with the mercury converter. Therefore, previously a semiconductor rectifier element having a current capacity which is far larger than the rated current, i.e., sufficiently resistant against the large current generated in case of a short-circuit accident in the direct current transmission system, has been used so as to avoid any trouble.

In this case, however, the cost of equipment becomes unavoidably expensive, therefore it is proposed that the known current limiting fuse recently used in alternating current systems be inserted in series with the semiconductor rectifier element, the fuse element being fused before a large current such as a short-circuited current reaches the current value which causes thermal breakdown of the semiconductor rectifier element so as to protect the element. However, the current limiting fuse widely used hereinbefore, a fuse device filled with quartz powder around the periphery thereof having a flat-sheet silver fuse element with a notched or narrow width portion in a pressure container has a continuous maximum current of about 1000A at the highest, but its cut-off time is very long such as more than 10–20 milliseconds. In the semiconductor converter at least 1000A is required as the continuous maximum current and a cut-off time of less than several milliseconds is required. As a result, such a fuse is incapable of protecting the semiconductor converter.

It is possible to meet the cut-off time requirement by making the cross-section of the fuse element small so as to make the fusing heat amount small, but the heat generation in the fuse element becomes large so as to lower of the continuous maximum current. Accordingly, a new technique should be used, otherwise no current limiting device for protecting a semiconductor AC-DC converter with a construction of the conventional current limiting fuse device can be obtained.

This invention improves the conventional fuse element into a hollow shape and at the same time develops a current limiting fuse device by forming a perforated cylindrical fuse device by sealing the fuse element with an arc suppression agent in one cylindrical body and immersing the perforated fuse device in a cooling and insulating oil.

SUMMARY OF THE INVENTION

An object of the present invention is to provide a current limiting fuse device having a large continuous current, a small fusing heat amount and a remarkably fast operating characteristic.

Another object of the present invention is to provide a current limiting fuse device having a broad applicable range from a low voltage to a extrahigh voltage.

A further object of the present invention is to provide a current limiting device having a high operating power characteristic in which heat from the fuse element generated by the transmission current is actively and largely removed by convection of a cooling and insulating oil, thereby making the operating current remarkably large as compared with that for the normal temperature, further making a cross-sectional area of the fuse element small so as to reduce the fusing time.

The current limiting fuse device according to the present invention comprises an outer casing filled with a cooling and insulating oil, a cylindrical body immersed in the cooling and insulating oil, having sealed therein a hollow fuse element with an arc suppression agent, and a pair of conductive terminal holding fittings each conductively coupled to a respective end of the hollow fuse element, secured to the respective ends of the cylindrical body at one end so as to allow the cooling and insulating oil to pass through an inner bore in the hollow fuse element, and projected from the outer casing at the other end.

Alternatively, the outer casing may be divided into two parts and these parts are joined with each other.

DESCRIPTION OF THE PREFERRED EMBODIMENT

Figure 1:
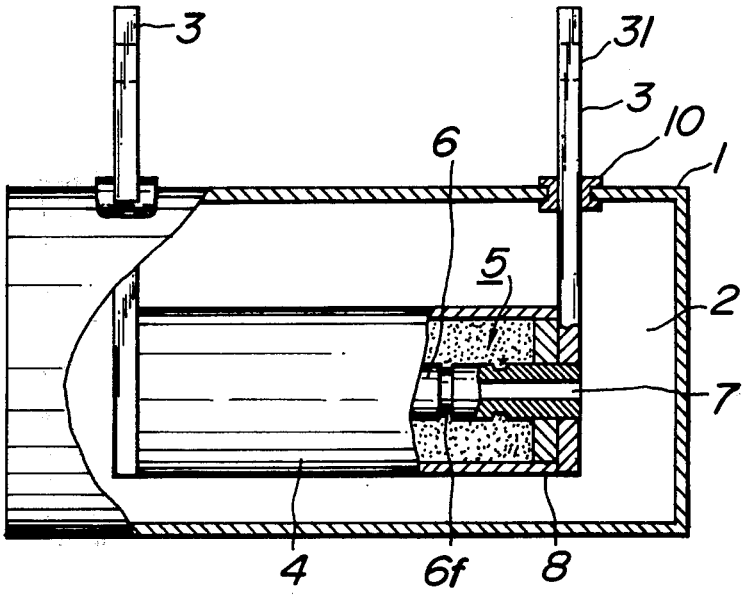
FIG. 1 is a partly broken front view showing an outline of one embodiment of a fuse device according to the present invention.
Figure 2:
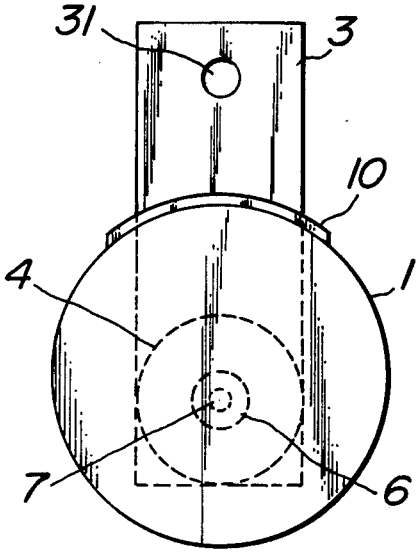
FIG. 2 is a right side view of the device of FIG. 1.

One embodiment of a current limiting fuse device according to the present invention is shown in FIGS. 1 and 2. In this embodiment an outer casing 1 is filled with a suitable amount of a cooling and insulating oil 2 under a pressure of one atmosphere or more. Cylindrical body 4 has an arc suppression agent 5 such as quartz particles and a hollow fuse element 6 sealed therein and is immersed in the cooling and insulating oil 2. The hollow fuse element 6 has an inner bore 7 in the longitudinal direction, is coupled to a pair of conductor terminal holding fittings 3 at either end in a conductive relationship and is further bridged between this pair of fittings 3 for constantly permitting the flow of the cooling and insulating filling the casing 1 through the inner bore 7. Element 8 is an end sealing annular body of the cylindrical body 4 and the end portions of the fittings 3 are secured to this annular body 8 by a screw (not shown). Connecting the cylindrical body 4 with the fitting 3 by screws is preferable for repairing the fuse device. Therefore, when repair, i.e., exchange of the fused fuse element is not required, other connecting means can be used.

The other ends of the conductor terminal holding fittings 3 project outwards by passing through a side plate of the casing 1. positively prevented Oil leakage from the casing 1 or permeation of air into the casing 1 between the side plate of the casing 1 and the penetrating portion of the fitting 3 is positively prevented; by superposing a proper shield member 10. This shield member 10 may be a rubber bushing having oil resistance and large electrical insulation resistance. In principle, it is necessary to provide thorough electrical insulation and water-tight construction between the conductor portion and the outer casing 1.

Silicone oil in the synthetic insulating oil series may be used in this embodiment as the cooling and insulating oil 2 filling the outer casing 1. Chlorinated oil with a proper erosion inhibitor added, sulfonic oil, fluorinated oil and the like, and insulating oil in the mineral oil series may be used the same as synthetic oil. It is preferable for the insulating oil employed to have large insulation breakdown strength, low viscosity, high ignition point, low coagulation point, no erosion of the parts of the fuse device, electrical and chemical stability, and particularly heat resistance such as the silicone oil mentioned above.

Further, it is preferable to form the outer casing 1 and the cylindrical body 4 of reinforced synthetic resin material or ceramics. It is also possible to use metal material having a proper surface insulation treatment, if necessary.

The fitting 3 is preferably made of highly conductive metal such as copper, aluminum or the like.

Figure 3:
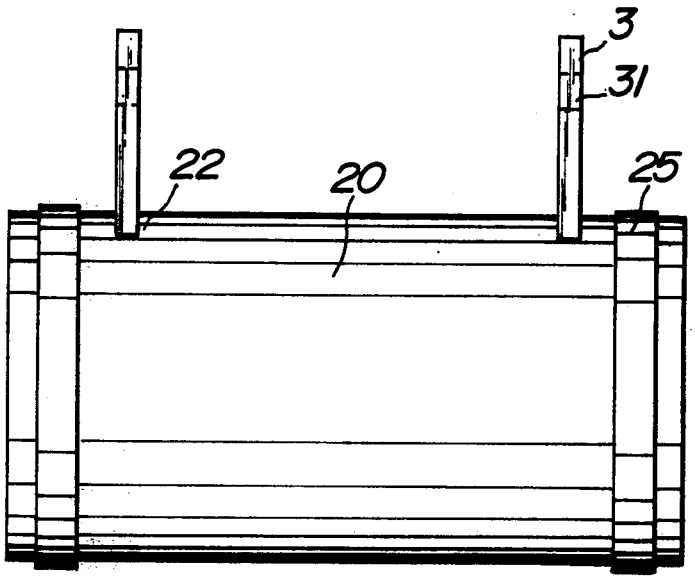
FIG. 3 is a front view showing another embodiment of a fuse device according to the present invention.
Figure 4:
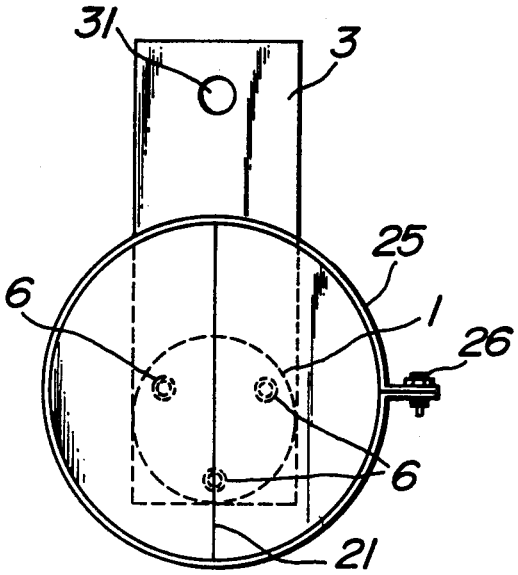
FIG. 4 is a right side view of the device of FIG. 3.

FIGS. 3 and 4 show a second embodiment of the fuse device according to the present invention, in which a division of the outer casing 20 is shown.

The outer casing 20 is divided into two portions as illustrated, and a portion 21 for joining the divided portions is bonded with the use of a proper bonding agent.

This divided casing 20 is reinforced with a number of fastening bands 25 in addition to the bonding agent. Each band 25 may be a metal band or a band member formed with synthetic resin or rubber. Further, the portions and numbers of the bands 25 to be applied are not limited to the illustrated embodiment but may be modified in accordance with the external size, weight and construction of the fuse device.

It is a matter of course that the divided casing 20 is provided with a threaded recess or opening 22 for projecting the end of the conductive terminal holding fitting 3. In the illustrated case, the casing 20 is formed of ceramics and the opening 22 is supplied with a shield agent and pressed against the side surface of the fittings 3.

Further, oil surface level display windows (omitted from the drawings) or provided pressure safety valves may be added at proper portions of the outer casings 1 and 20 shown in the above first and second embodiments.

Further, the conductor terminal holding fitting 3 may be constructed to project from both sides of the outer casings 1 and 20.

The hollow fuse element 6, as shown in FIG. 1, is formed with a recessed groove **6*f* having the proper width so as to reduce the fusing heat amount of the desired fuse and to obtain the desired fast operating characteristic. Further, the shape of the inner bore 7 may be a simple circle as illustrated or the inner peripheral surface may be a corrugated form or in the shape of a plurality of divided holes for enhancing the cooling effect by the cooling and insulating oil 2**.

Further, as shown in FIG. 4, bridging is made by integrating the hollow fuse element 6 within the cylindrical body 1. Of course the cooling and insulating oil 2 is allowed to flow through the bores of each fuse element in this case, too.

As understood from the above explanation, the fuse device according to the present invention actively cools the fuse element with the flow of the cold medium insulating oil through the through-hole and removes the generated heat of the fuse element by the cooling and insulating oil, so that it can increase the continuous operating current of the conventional fuse element by a large margin, and simultaneous sealing of the arc suppression agent can shorten arc duration. Further, if the cooling and insulating oil is filled and sealed by properly elevated sealing pressure, the arc suppression action under high pressure is effectively performed, and an excellent current limit effect can be obtained.

According to an experiment by the inventor, it is confirmed that the fusing time of the cooled fuse element does not show any remarkable difference from the case at a normal temperature, and it is found that the degree of increase in operating current is far larger than that of the fusing heat amount. This fact shows that regardless of the design of the cross-sectional area of the fuse element 6, a continuous maximum operating current can be freely obtained by optionally selecting the flow amount, the filling amount and the characteristics of oil.

As a result, according to the present invention, it is possible to provide a current limiting fuse device for protecting against excess current, which has excellent capability of current flow as compared with a conventional current limiting fuse and further has a current limiting effect.

What is claimed is:

1. A current limiting fuse device comprising:

a cylindrical body;

a hollow fuse element inside said cylindrical body having the ends sealed to said cylindrical body and having a bore therethrough in the direction of the longitudinal axis of said cylindrical body, said cylindrical body having a space between said cylindrical body and said hollow fuse element;

an arc supression agent in the space between said cylindrical body and said hollow fuse element;

an outer casing enclosing said cylindrical body and defining a space around said cylindrical body;

a pair of conductive terminals, each electrically connected to a respective end of said hollow fuse element and projecting out of said outer casing; and a cooling and insulating medium enclosed in the space between said outer casing and said cylindrical body and said bore of said hollow fuse element.

2. A current limiting fuse device as claimed in claim 1, wherein said outer casing comprises two parts and said two parts are joined with each other.

3. A current limiting fuse device as claimed in claim 1, wherein said cooling and insulating medium is selected from the group consisting of silicone oil in the synthetic insulating oil series, chlorinated oil with an erosion inhibitor added, sulfonic oil, fluorinated oil and insulating oil in the mineral oil series.

* * * * *